United States Patent [19]

Masuno

[11] Patent Number: 4,561,411

[45] Date of Patent: Dec. 31, 1985

[54] IGNITION SYSTEM FOR INTERNAL COMBUSTION ENGINE

[75] Inventor: Katsuyoshi Masuno, Hyogo, Japan

[73] Assignee: Mitsubishi Denki Kabushiki Kaisha, Tokyo, Japan

[21] Appl. No.: 645,188

[22] Filed: Aug. 29, 1984

Related U.S. Application Data

[62] Division of Ser. No. 426,595, Sep. 29, 1982, Pat. No. 4,494,519.

[30] Foreign Application Priority Data

Oct. 1, 1981 [JP] Japan ..... 56-146939[U]

[51] Int. Cl.[4] ..... F01P 1/00

[52] U.S. Cl. ..... 123/615; 123/619; 123/645

[58] Field of Search ..... 123/615, 619, 645

[56] References Cited

U.S. PATENT DOCUMENTS

| | | | |
|---|---|---|---|
| 3,361,123 | 1/1968 | Kasama | 123/619 |
| 3,550,571 | 12/1970 | Mainprize | 123/619 |
| 3,587,552 | 6/1971 | Varaut | 123/615 |
| 3,736,463 | 5/1973 | Basso | 123/645 |
| 4,334,509 | 6/1982 | Nash | 123/615 |
| 4,347,827 | 9/1982 | Lo Cascio | 123/645 |
| 4,494,517 | 1/1985 | Masuno | 123/615 |

*Primary Examiner*—Ronald B. Cox

*Attorney, Agent, or Firm*—Sughrue, Mion, Zinn, Macpeak and Seas

[57] ABSTRACT

A breakerless ignition system includes a resonant circuit whose oscillation is controlled by the relative position between a detector coil 2a embodied therein and a magnetically permeable rotor 1 driven by the engine, and a threshold detector 3 responsive to the oscillation signal envelope for controlling the supply of energy to an ignition coil 6 via a power switching transistor 5. To prevent false triggering of the detector due to spurious signals induced in the coil by the spark ignition firings, a monostable multivibrator 8 actuated by the trailing edge of the detector output holds the transistor deenergized for a predetermined period of time after it has been turned off. The multivibrator output may resistively ground the resonant circuit, or it may disable the transistor via an inverter 11 and AND gate 12.

2 Claims, 9 Drawing Figures

ROTOR PROJECTION OPPOSITE CORE
NO PROJECTION OPPOSITE CORE

DETECTOR THRESHOLD

0

0

0

0

IGNITION SYSTEM FOR INTERNAL COMBUSTION ENGINE

This is a division of application Ser. No. 426,595, filed Sept. 29, 1982, now U.S. Pat. No. 4,494,519.

BACKGROUND OF THE INVENTION

This invention relates to a breakerless ignition system for internal combustion engines which detects ignition timing in response to a variation in the condition of oscillation of a resonant circuit composed of a capacitor and a coil which is wound on a core disposed in confronting relation to a signal rotor.

With prior art ignition systems of this type, noise signals are sometimes induced in the detector coil of the resonant circuit by extraneous electromagnetic radiations generated by the spark plug firings, and the intensity of the resonant oscillations is increased by the energy of such induced noise signals. As a consequence, a threshold detector coupled to the resonant circuit may produce spurious output signals which temporarily switch on a power transistor connected in series with the ignition coil, whereby erroneous firing pulses are developed in the secondary winding of the coil and the voltage and energy outputs of the latter are generally decreased.

SUMMARY OF THE INVENTION

The present invention effectively eliminates the above-described shortcomings of such prior art ignition systems for internal combustion engines by providing circuit means for forcibly holding the power transistor in a deenergized state for a predetermined interval of time after it has been switched off to thereby prevent the transistor from being erroneously energized by spurious or extraneous signals induced in the system.

DETAILED DESCRIPTION OF THE PREFERRED EMBODIMENTS

Figure 1:
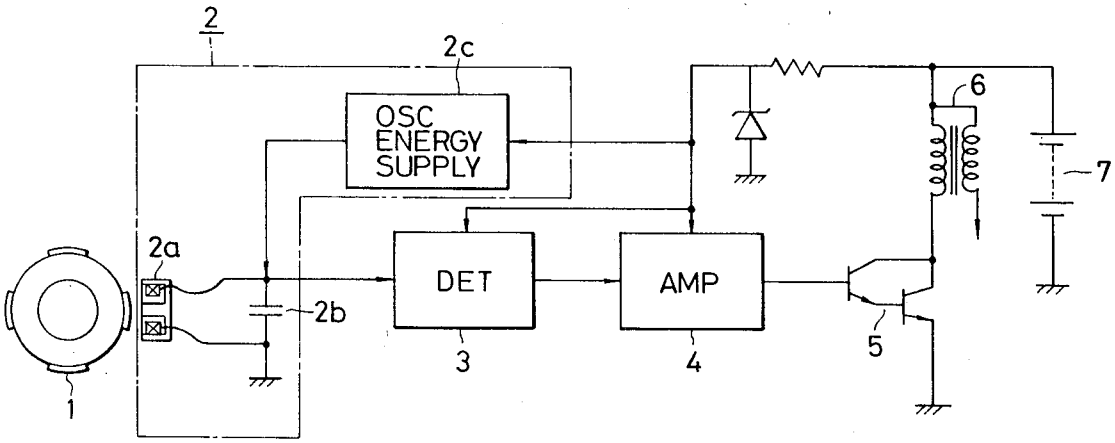
FIG. 1 shows a block diagram of an ignition system for an internal combustion engine of the type with which this invention is concerned, FIGS. 2(*a*) through 2(*e*) show waveform diagrams generated during the operation of the system of FIG. 1.

Referring to FIG. 1, a signal generator unit mounted in a distributor (not shown) comprises a magnetically permeable rotor 1 driven in synchronism with an internal combustion engine (not shown), and a core mounted in confronting relation to the rotor and having a coil 2*a* would around a central leg thereof. An electronic oscillator circuit 2 embodying the detector coil comprises a capacitor 2*b* connected in parallel with the coil to form a resonant circuit, and a supply circuit 2*c* for delivering oscillation energy to the resonant circuit. The remaining components include a threshold detector 3 for monitoring the oscillation condition of the resonant circuit, an amplifier 4 for amplifying the detector output, a power transistor 5 (Darlington pair) driven by the amplifier output, an ignition coil 6 having its primary winding connected in series with the transistor, and a battery 7.

Figures 2A, 2B, 2C, 2D, 2E:
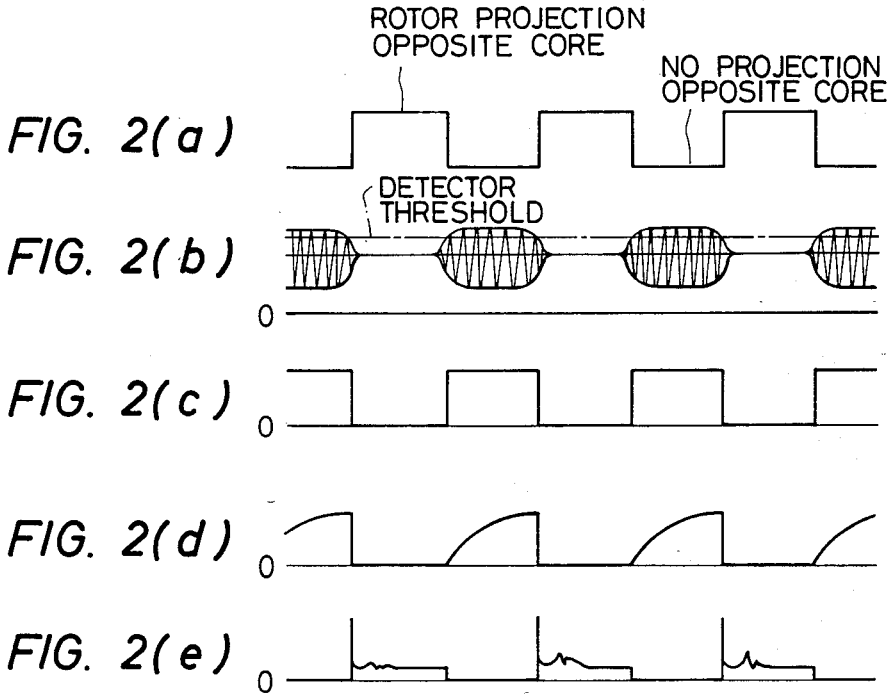

In operation, when the rotor 1 is driven in synchronism with the rotation of the engine, the detector core confronting the rotor and magnetically permeable projections on the latter move relative to each other in a pattern as generally illustrated in FIG. 2(*a*). The coil 2*a* wound on the core and the capacitor 2*b* are interconnected, and jointly constitute a resonant circuit as mentioned above. The resonant circuit is supplied with oscillation energy from the circuit 2*c*. When a rotor projection does not lie opposite the core, the resonant circuit oscillates to produce a waveform as shown in FIG. 2(*b*) whose amplitude is such that the energy loss in the resonant circuit is counterbalanced by or equal to the energy supplied from the circuit 2*c*. When a rotor projection is disposed opposite the core, on the other hand, substantial magnetic flux is coupled into the rotor and the oscillation signal becomes extinguished due to eddy current and hysteresis losses.

When the amplitude of the oscillation signal exceeds the threshold level shown in FIG. 2(*b*), the detector 3 produces a raised output as shown in FIG. 2(*c*) which, after amplification, is applied to transistor 5 as a switching signal. When the transistor is conductive, an electrical current builds up in the primary winding of the ignition coil 6 as shown in FIG. 2(*d*). When this current flow is terminated in response to the oscillation signal falling below the detector threshold, a high voltage spike is generated in the secondary winding of the ignition coil as shown in FIG. 2(*e*), which is applied as a firing pulse to an associated spark plug.

With a system of this general type noise signals are often induced in the detector coil 2*a* due to the spark ignition firings as mentioned above, and such induced signals may falsely trigger the detector 3 and thereby adversely affect the performance of the ignition system.

Figure 3:
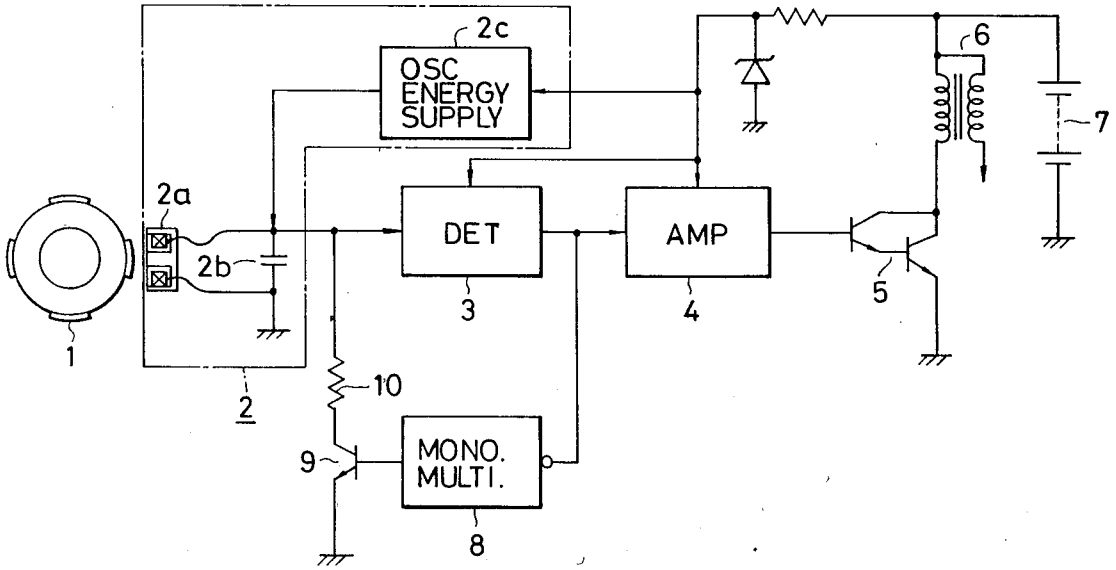
FIG. 3 shows a block diagram of an ignition system according to a first embodiment of the present invention.

The present invention effectively overcomes these disadvantages, and a first embodiment thereof will now be described with reference to FIG. 3 wherein a monostable multivibrator 8 is triggered by a negative-going edge of any output pulse from the detector 3 as shown in FIG. 2(*c*). The output of the multivibrator switches a transistor 9 on for a predetermined period of time. A resistor 10 is connected in series between the input to the detector 3 and the collector of transistor 9.

In operation, when the resonant oscillation signal falls below the threshold level, the output of detector 3 drops to switch off the power transistor 5 through the amplifier 4, whereupon a high voltage ignition signal is generated in the secondary winding of the ignition coil 6. In response to such dropped output of the detector 3, the multivibrator 8 turns on and maintains the transistor 9 energized for a period of time determined by the circuit constants of the multivibrator. During this predetermined time, the spark ignition firings may induce noise signals in the detector coil 2*a* of the oscillator circuit 2. Since the transistor 9 is held on during this time period, however, any such noise signals are immediatly absorbed by the resistor 10 and thereby do not temporarily increase the intensity of the resonant oscillation signal. This effectively prevents the false triggering of the detector 3 and thereby avoids the system malfunctions attendant with the prior art ignition systems. Upon the elapse of the time interval determined by the circuit constants of the monostable multivibrator 8, the transistor 9 is switched off and the ignition system is then enabled to be properly responsive to further oscillations of the resonant circuit due to relative movement between the rotor 1 and the detector coil *2a*.

Figure 4:
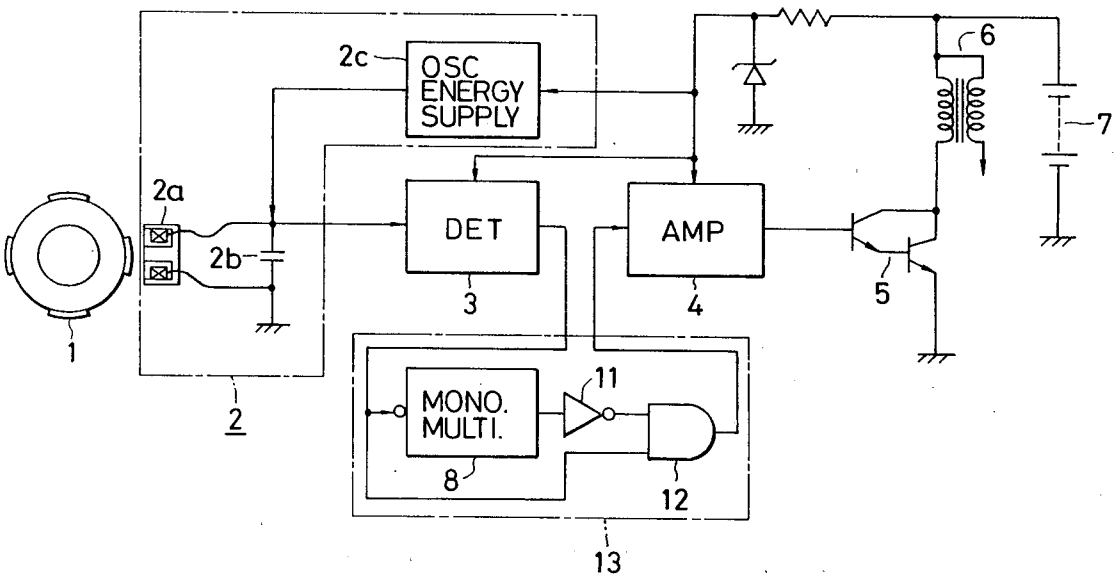
FIG. 4 shows a block diagram of an ignition system according to a second embodiment of the invention.
Figure 5:
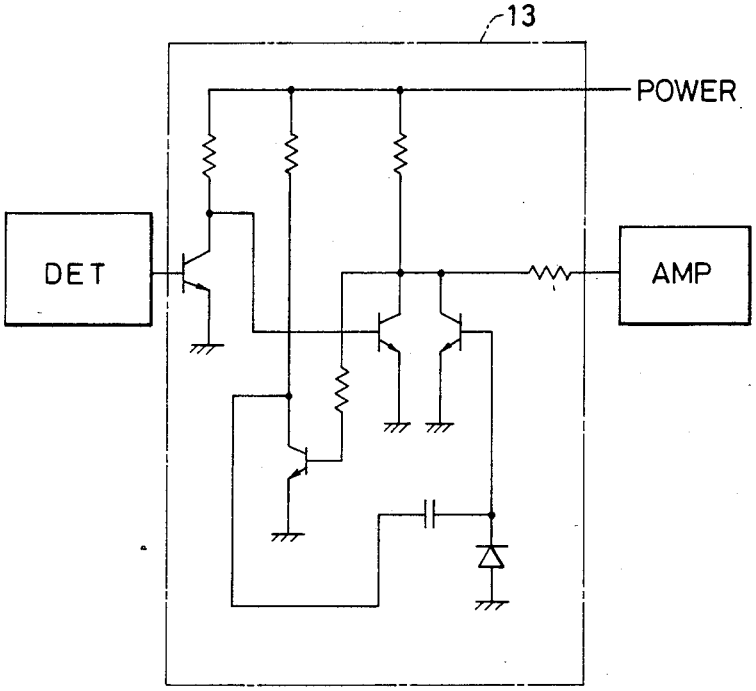
FIG. 5 shows a schematic circuit diagram of a portion of the ignition system of FIG. 4.

A second embodiment of the invention is illustrated in FIGS. 4 and 5, wherein the output of detector 3 is not directly coupled to the amplifier 4 but instead is channeled through a malfunction prevention circuit 13. Such prevention circuit includes the monostable multivibrator 8 which is again triggered by a negative-going or trailing edge of any output pulse from the detector. In this instance, however, the multivibrator output drives an inverter 11 whose output in turn is coupled to an AND gate 12 together with the detector output; the AND gate output is applied to the amplifier 4.

In operation, when the detector output drops as a result of the oscillation signal falling below the threshold level the multivibrator 8 is triggered but due to the inverter 11 a down input is applied to the AND gate 12 for a predetermined period of time which, along with the other down input applied directly to the AND gate from the detector output, drops the AND gate output to thereby switch the power transistor 5 off and generate an ignition spike in the secondary winding of the coil 6. Any spurious noise signals thereafter induced in the detector coil *2a* by the spark ignition firing may temporarily increase the intensity of the resonant oscillation signal and falsely trigger the detector 3, but since the AND gate 12 remains disabled by the inverter 11 for a time period determined by the circuit constants of the multivibrator, the power transistor 5 is held off and hence the false triggering signals cannot pass through the system to cause malfunctions. When the time interval determined by the multivibrator has elapsed its output drops, and the inverter output correspondingly rises to enable the AND gate 12 for subsequent "normal" operation.

In the foregoing embodiments, the power transistor 5 is switched off when a rotor projection moves toward the detector coil *2a*, but as will readily be appreciated by those skilled in the art, the ignition system could equally be constructed such that the transistor 5 is switched off at the beginning of a resonant oscillation cycle. As will also be obvious, the duration of the time delay established by the circuit parameters of the monostable multivibrator 8 will be slightly less than the dead or oscillation suppression time between successive resonant cycles to thereby re-enable the system for normal operation in a timely manner.

No detailed description of the schematic diagram of the malfunction prevention circuit 13 shown in FIG. 5 is believed necessary as its construction and operation is quite conventional and will be readily understood by those skilled in the art.

What is claimed is:

1. A breakerless ignition system for an internal combustion engine comprising: a magnetically permeable rotor (1) driven in synchronism with an internal combustion engine, a core disposed in confronting relation to said rotor and having a coil (*2a*) wound therearound, a capacitor (*2b*) connected to said coil to form a resonant circuit therewith, a supply circuit (*2c*) for supplying said resonant circuit with oscillation energy, a threshold detector circuit (3) for detecting the condition of oscillation of said resonant circuit, an amplifier (4) for amplifying an output signal from said detector circuit, a switching element (5) driven by an output signal from said amplifier, an ignition coil (6) for generating a high voltage in response to intermittent operation of said switching element, and means for holding said switching element in a deenergized state for a predetermined period of time after it has been turned off to prevent false triggering by the detector circuit due to spurious signals induced in the coil by spark ignition firings, said holding means comprising: (a) a monostable multivibrator (8) triggered by the detector circuit output simultaneously with the deenergization of said switching element, and (b) means for driving said switching element jointly by an output signal from said multivibrator and said detector circuit output.

2. An ignition system according to claim 1, wherein said driving means comprises an inverter (11) responsive to said multivibrator output signal, and an AND gate (12) responsive to an output of said inverter and said detector circuit output, an output of said AND gate controlling said switching element.

* * * * *